US010774622B2

(12) United States Patent
Wright

(10) Patent No.: US 10,774,622 B2
(45) Date of Patent: Sep. 15, 2020

(54) PIPELINE BOOSTER PUMP SYSTEM FOR PROMOTING FLUID FLOW

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 16/336,821

(22) PCT Filed: Sep. 27, 2017

(86) PCT No.: PCT/US2017/053808
§ 371 (c)(1),
(2) Date: Mar. 26, 2019

(87) PCT Pub. No.: WO2018/064216
PCT Pub. Date: Apr. 5, 2018

(65) Prior Publication Data

US 2020/0024933 A1 Jan. 23, 2020

Related U.S. Application Data

(60) Provisional application No. 62/400,571, filed on Sep. 27, 2016.

(51) Int. Cl.
*E21B 43/01* (2006.01)
*E21B 43/12* (2006.01)
*E21B 43/16* (2006.01)

(52) U.S. Cl.
CPC ..... *E21B 43/01* (2013.01); *E21B 43/121* (2013.01); *E21B 43/16* (2013.01)

(58) Field of Classification Search
CPC ..... E21B 43/01; E21B 43/121; E21B 43/16
USPC ..... 166/335, 344
See application file for complete search history.

(56) References Cited

U.S. PATENT DOCUMENTS

2010/0119382 A1* 5/2010 Scarsdale ..... F04B 35/04 417/53
2015/0107683 A1* 4/2015 Dass ..... F17D 3/00 137/15.11
2016/0138346 A1* 5/2016 Lessmann ..... E21B 23/01 166/339

FOREIGN PATENT DOCUMENTS

WO 200174473 A1 10/2001
WO WO-0174473 A1 * 10/2001 ..... E21B 43/01
WO 2003067147 A1 8/2003

* cited by examiner

*Primary Examiner* — James G Sayre
(74) *Attorney, Agent, or Firm* — Matthews, Lawson, McCutcheon & Joseph, PLLC

(57) ABSTRACT

The present invention comprises a pumping system operable at the surface (e.g., on a surface platform) to increase or restore hydrocarbon flow from a deep water or ultra deep water subsea environment to a surface production facility. The system comprises a primary conduit coupled to a Y-block splitting into two secondary conduits, one being open and free of obstruction, the other containing a progressive cavity pump coupled to a motor which acts as the prime mover for the pump system. The system may also comprise one or more valves between the primary conduit and the Y-block, one or more valves and between the secondary conduits and the Y-block. An emergency quick disconnect may also be used as part of the system between the Y-block and the secondary conduits.

16 Claims, 3 Drawing Sheets

| ROTOR | | | | | STATOR | | | RATE | | PRESSURE | |
|---|---|---|---|---|---|---|---|---|---|---|---|
| M (mm) | G (mm) | D (mm) | F (mm) | E THREAD API 11 B | A (mm) | B (mm) | C (mm) | B/D (rpm) | $M^3$/D (rpm) | PSI | BAR |
| ABOUT 9425 | ABOUT 9200 | ABOUT 71.5 | ABOUT 84.1 | ABOUT 3.96 cm (1.9/16 in.) FOR ROD 2.86 cm (1.1/8 in.) | ABOUT 8550 | ABOUT 9265 | ABOUT 600 | ABOUT 4.65 | ABOUT 0.740 | ABOUT 3500 | ABOUT 240 |

PIPELINE BOOSTER PUMP SYSTEM FOR PROMOTING FLUID FLOW

CROSS-REFERENCE TO RELATED APPLICATIONS

The present application is a US national stage application claiming priority to Patent Cooperation Treaty (PCT) Application No. PCT/US17/53808, filed 27 Sep. 2017, which in turn claims priority to U.S. Provisional Application No. 62/400,571, filed 27 Sep. 2016. Both prior applications are titled "Pipeline Booster Pump System For Promoting Fluid Flow," and their full contents are incorporated herein by reference.

FIELD OF THE APPLICATION

The application relates generally to promoting flow or transfer of fluids through subsea conduits to a surface and/or production facility.

BACKGROUND

In a variety of subsea applications, the production of oil, hydrocarbons, or other production fluids from subsea production zones may be limited, restricted, or written off entirely due to the presence of water within the production zone. Specifically, as the production fluids are produced from a zone, and as the zone depletes, water may permeate into the pipeline, decreasing the production, lowering the pressure or the production zone, and generally hindering profitability of a well system. In some instances, this decrease in productivity, caused by the influx of water, necessitates the temporary shutdown of a well system, or a complete abandonment of a reserve as unprofitable. Additionally, fluids from the subsea production zones may be directed from one locale to another. Depending on the activity, fluid may be directed through subsea flowlines located on the seafloor or directed upwardly from a subsea well, pipe or pipeline, pipeline end termination (PLET), a vessel, or other container to the water surface. In some cases a subsea pump is used to direct subsea fluids from one locale to another.

In one known subsea pumping technique, hydraulic drive systems have been employed for powering subsea pumps. However, the motor powering the pump may have to overcome a given hydrostatic pressure when returning motor fluids back to the water surface, and the result may include a time intensive endeavor placing an unwanted load on the motor powering the subsea pump.

In another known subsea pumping technique, electric drive systems have been employed to power subsea pumps. However, at great depths it may be difficult to supply the necessary current and amperage to effectively pump fluids to the water surface.

A more efficient technique for transporting subsea fluid and maintaining productivity in subsea production zones is desired.

In petroleum production, oil and its byproducts are typically removed from wells and transported through pipelines, including subsea pipelines. The flow of oil and other fluids through a subsea pipeline can lead to the buildup of different substances within the pipe impeding fluid flow there through. For example, scale, paraffin wax, wax plugs, paraffin plugs, hydrates, ice plugs, asphaltenes, debris or sand may build up in the pipeline over time depending on the nature of the fluid flowing through the pipeline and other surrounding circumstances.

One method to prevent the formation of paraffin deposits is to heat the pipelines. However, this method is very expensive and is not feasible for subsea pipelines submerged in the cold sea water.

Another method involves "pigging", wherein a mechanical device is passed through the pipeline scraping the inner wall of the pipeline and pushing paraffin deposits through. However, the pigging tools (e.g., mechanical tools used for maintenance) then require removal, from the pipeline or well, for increasing or restoring the flow of hydrocarbons from subsea environments.

Another method for removing paraffin deposits is "hot oiling," wherein a heated oil is pumped through the pipeline in order to remove the paraffin wax deposits. However, again this can be expensive and not very feasible for subsea environments.

Another cause of blockage in subsea pipelines is the formation of gas hydrates where an aqueous phase is inherently present, during the transportation of fluids including gases. This is a common problem, especially in deep sea conditions including low temperatures and/or high pressures. Low temperatures and the presence of water can lead to the formation of these gas hydrates in the pipelines.

One method of dealing with gas hydrates is to insulate the pipeline. But, this approach is typically expensive. Another method is to pump methanol through the pipeline or to use chemical methods, such as addition of anti-agglomerates (e.g. kinetic inhibitors or thermodynamic inhibitors). However, to be effective, large quantities of these chemicals are required making the process expensive.

Other problems associated with production of hydrocarbons can include increased hydrostatic pressure due to the accumulation of water in the pipeline or producing zone (e.g., a pipeline, a PLET, a producing well, or combinations thereof). Accordingly, improved systems and methods are needed for providing the flow, or increasing the flow, of hydrocarbons form a subsea environment to a surface and/or production facility.

SUMMARY

The present application is directed to a pumping system operable at the surface (e.g., a surface platform) for increasing or restoring the flow of hydrocarbons, from a subsea environment to a surface and/or surface production facility.

One embodiment of the present invention is directed to a subsea pipeline booster pump system, the system comprising a primary conduit forming a fluid connection between a valve assembly and a production zone, a Y-block fluidly connected to the valve assembly, wherein the Y-block divides the primary conduit into an open secondary conduit and a pump secondary conduit, wherein the pump secondary conduit comprises a pump assembly internal to the pump secondary conduit, wherein the pump assembly comprises a progressive cavity pump.

This embodiment may further comprise at least one valve between the Y-block and the open secondary conduit, at least another valve between the Y-block and the pump secondary conduit, or at least one emergency quick disconnect (EQD), the EQD selectively releasing the at least one valve, the at least another valve, or both, from the Y-block. This EQD can be operationally configured to release upon receiving an electric or acoustic signal initiated from the surface. The open secondary conduit may comprise a clear fluid path leading to a production facility, while the pump secondary conduit is in fluid communication with the production facility. Embodiments may include switch valves between the production facility and the secondary conduits to selectively control fluid communication, anchoring sections within the pump assembly securing it to a specific location along the inner wall of the pump secondary conduit (through, e.g., compressible packers, bolts, locks, clips, hooks, or other latch mechanisms).

A further method embodiment is directed to a method of pumping fluid from a subsea environment to a surface production facility, the method comprising attaching a primary conduit to a pipeline or pipeline end termination, splitting the primary conduit into an open secondary conduit and a pump secondary conduit by means of a Y-block, connecting the open secondary conduit to the surface production facility, and powering a motor and a progressive cavity pump located within the pump secondary conduit.

The method embodiment may further comprise attaching at least one emergency quick disconnect (EQD) system between the Y-block and the open secondary conduit, or between the Y-block and the pump secondary conduit, wherein the EQD system disconnects the Y-block from the open secondary conduit and the pump secondary conduit upon receipt of a signal from the surface production facility. Embodiments may include wherein the step of powering the motor and progressing cavity pump involves hydraulics, electric power, pneumatics, or combinations thereof, or wherein the step of attaching the primary conduit to the pipeline or pipeline end termination comprises attaching a valve assembly on a surface platform to a deep water or ultra deep water production zone.

DETAILED DESCRIPTION

Figure 1:
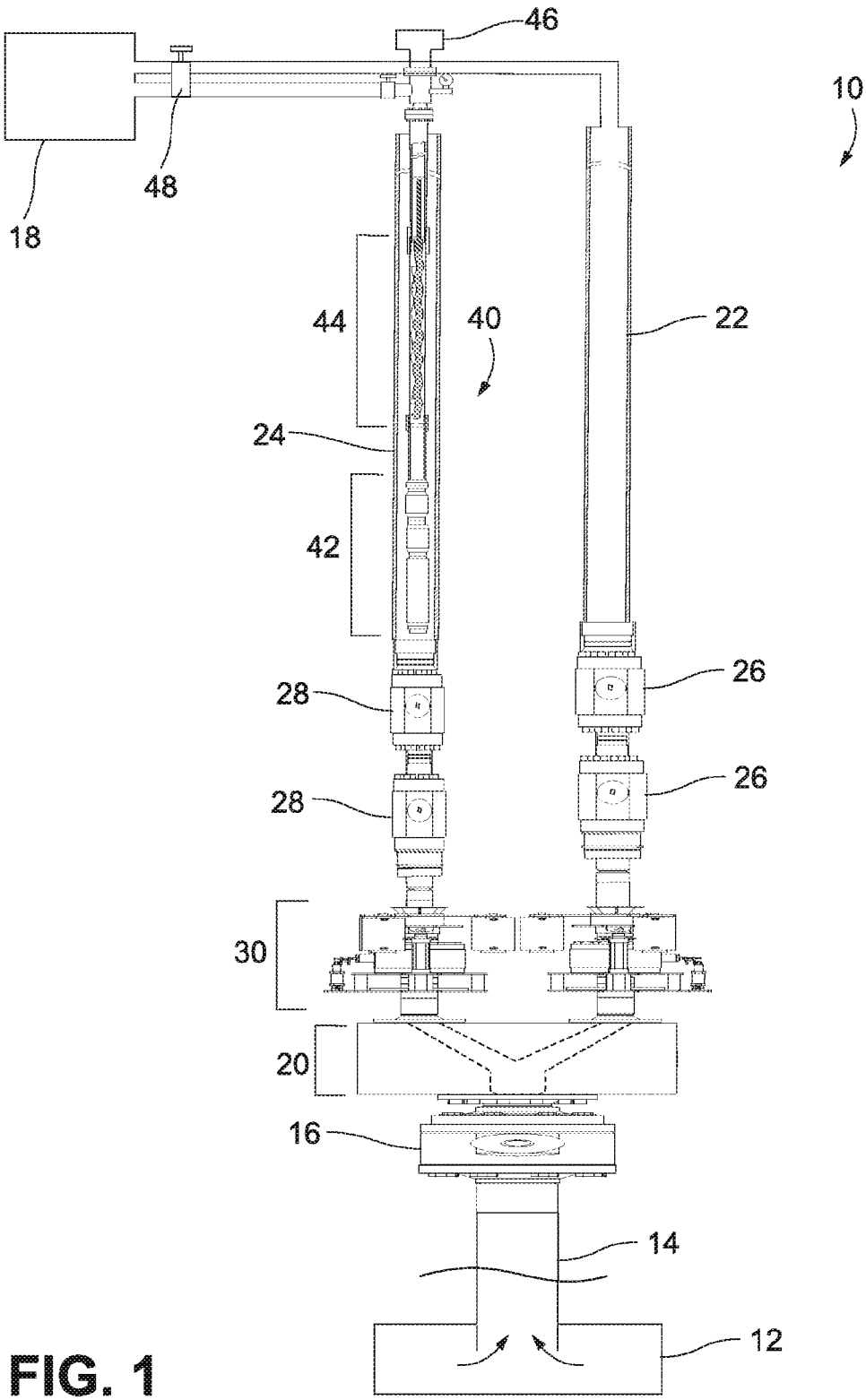
FIG. 1 illustrates an embodiment of a pipeline booster pump system that may be used in production of fluid comprising hydrocarbons from a subsea production zone.

The present application relates, generally, a pumping system that is operable at the surface (e.g., a surface platform) for increasing or restoring the flow of hydrocarbons, from a subsea environment to a surface and/or surface production facility.

A motor may be used as a prime mover for a pump system to transfer fluids found in subsea environments, and maybe usable in such activities as hydrate recovery or remediation, pipeline abandonments, dewatering pipelines, subsea well kill operations, well draw downs, and for flushing subsea pipelines by increasing the flow rate of fluid to the surface of the water as compared to the flow rate generated by electric motors and hydraulic motors. In operation, the motor can be suitably powered by hydraulics, electric power and/or pneumatics. In an embodiment, the pump can be a progressive cavity pump (PCP or corkscrew pump).

Before describing the invention in detail, it is to be understood that the present system and method are not limited to particular embodiments. It is also to be understood that the terminology used herein is for the purpose of describing particular embodiments only, and is not intended to be limiting. As used in this specification and the appended claims, the phrase "motor" refers to a hydraulic motor, electric motor, and/or pneumatic motor. The phrase "deep water" includes subsea depths from about 914 m to about 2286 m (about 3,000 feet to about 7,500 feet). The phrase "ultra deep water" includes subsea depths of about 2286 m or more (about 7,500 feet or more). The term "PLET" stands for pipeline end termination. The phrase "surface platform" refers to a floating vessel, a stationary platform above the surface of the water, or dry land. The term "pipeline" refers to a conduit made from pipes connected end-to-end for fluid transport, including but not necessarily limited to petroleum conduits located above ground, underground, and subsea. The phrase "sea water" refers to water originating from the lake, sea, or ocean in which the present system is operating. The acronym "BPM" refers to barrels per minute. The acronym "LPM" refers to liters per minute. The acronym "GPM" refers to gallons per minute. The term "surface" as such relates to the present subsea system refers to the water surface of the body of water containing the system. Rotatable and turnable devices include those devices acted on by a corresponding drill motor of this application. Without limiting the types of rotatable and turnable devices, suitable devices for subsea purposes may include the rotating armature of a motor, pump or generator.

In one aspect, the application provides a system providing for the conveyance of fluid from a subsea locale to a surface locale.

In another aspect, the application provides a means for pumping fluid from a subsea environment to the surface using a pump (e.g., PCP pump) powered by a motor, the motor in turn being powered by hydraulics, electricity, and/or pneumatics.

In another aspect, the application provides a system and method for pumping fluid from a subsea location to the surface using a motor and a pump (e.g., PCP). The system can include a flex-shaft seal assembly coupled to the pump rotor to compensate for the eccentric rotation and vibration of the pump.

In another aspect, the application provides a system and method for subsea pipeline hydrate remediation.

In another aspect, the application provides a system and method for subsea pipeline blockage or plug remediation, including hydrate plugs or ice plugs, wax plugs, paraffin plugs, sand debris, and other debris forming blockages or plugs.

In another aspect, the application provides a system and method for pipeline "pigging," as the term is known to persons of ordinary skill in the petroleum industry, including the removal of the pipeline pigging tools.

In another aspect, the application provides a system and method for dewatering pipelines in deep water and ultra deep water.

In another aspect, the application provides a system and method for chemical injection into subsea pipelines in deep water and ultra deep water, and/or the removal of chemicals from subsea pipelines and/or wells.

In another aspect, the application provides a system and method for moving fluid from a subsea location to the surface of the water at a hydrostatic pressure up to about 463 bar (about 6708 psi).

In another aspect, the application provides a system and method for pumping fluid from a subsea pipeline at a depth of about 2134 meters (about 7,000 feet) to the surface of the water at a rate about 75 liters (about 20 gallons) or more per minute.

In another aspect, the application provides a system operationally configured to pump fluid from such depth to the water surface at a rate of about 227 liters (about 60 gallons) or more per minute.

In another aspect, the application provides a system and method effective for dropping pressure within a pipeline downstream of an ice plug or other plug or blockage.

In another aspect, the application provides a system operationally configured to be tested, repaired or otherwise serviced above the surface of the water.

In another aspect, the application provides a system including at least a motor, pump, valve assembly, and y-block for connecting to a pipeline to increase or restore the flow of hydrocarbons, to a production facility. The system can include an emergency quick disconnect as described below.

In another aspect, the application provides a system that may be built to scale.

In another aspect, the application provides a system located on or tethered to a surface platform or vessel. Alternatively, the system may be located on or tethered to one or more land based components.

In another aspect, the application provides a system that meets all required American Petroleum Institute ("A.P.I.") tolerances. In another aspect, the system tolerances are greater than the corresponding A.P.I. tolerances.

In another aspect, the application provides a system operationally configured for deep water or ultra deep water pumping of fluid from the seafloor to the surface, the system being operationally configured to recover about seven times more fluid from a subsea locale than is necessary to power a pump means.

To better understand the novelty of the system and method of use thereof, reference is hereafter made to the accompanying drawings. With reference to FIG. 1, a simplified illustration of a pipeline booster pump system 10 is provided. Suitably, the system 10 may be installed as an above-sea finishing pump to a subsea system that includes a motor 46. With reference to FIG. 1, the system 10 may be configured to operate in conjunction with one or more fluid sources (e.g., hydrocarbons, natural gas, water, etc.) or production zones 12 to produce increased fluid flow of the fluid (e.g., hydrocarbons, natural gas, water etc.). For example, the present system 10 may be operationally configured for boosting production in depleted production zones, dewatering pipelines, subsea hydrate recovery or remediation, plug remediation, dewatering purposes, flushing purposes, cleaning purposes, evacuation purposes, recovery purposes, testing pipeline integrity, pipeline maintenance and combinations thereof. In a particularly advantageous embodiment, the system 10 may be operationally configured for use at the surface where fluid is being produced from deep water or ultra deep water environments.

The system 10 may be installed in or on a surface platform, and may comprise at least one motor, at least one pump, at least one valve assembly (e.g., dual valve assembly, additional valve assembly), and a y-block assembly. The system 10 can include an emergency quick disconnect as discussed below.

Fluid flow within the system 10 is provided via fluid conveyance (hereafter referred to as "conduit"), which may include conventional metal piping, coiled tubing, flexible hose, flexible piping, and combinations thereof. As shown, a conduit 14 (e.g., pipeline) is operationally configured to provide a fluid connection between a valve assembly 16 on the surface platform and the production zone 12 for conveying fluid from the subsea environment to a surface and/or a production facility 18. It will be understood that the conduit 14 may include one or several pipes, tubes, tubulars, or layers of such for enabling the flow of the fluid from the subsea environment to the surface. As described above, the production fluid from the production zone 12 may, over time, become less productive and, as such, have a measurable decrease in the pressure in the production fluid. In addition, the decrease in production fluid may allow water (e.g., sea water) to permeate the production zone and flow into the conduit 14, further decreasing the flow of fluid within the pipeline.

For times when the production zone operates with an excess of pressure, or the booster pumping system can create the pressure needed for the flow of the fluid, the system 10 includes a y-block 20. The y-block 20 divides the fluid flow from into the open conduit 22 and the pump conduit 24. The open conduit 22 includes a clear path for the production fluid, which enables fluid to flow cleanly to the production facility 18. The open conduit 22 may include one or more valves 26 to ensure that the production fluid does not build up pressure in any unwanted location along the open conduit 22. The pump conduit 24 likewise includes valves 28 (e.g., dual valve assembly) for related purposes, and is likewise fluidly connected to the production facility 18. Switch valve 48 enables selective communication from the production facility 18 to the open conduit 22 and the pump conduit 24. While the illustrated embodiment shows two valves 28, certain embodiments may have one valve 28, three valves 28, four valves 28, or more depending on the pressures being pumped and the needs of the system 10. The system 10 may also include at least one emergency quick disconnect (EQD) 30 for releasing the valves 26, 28 from the y-block 20 for maintenance, treatment, replacement, or other servicing of the system 10.

The pump conduit 24, in certain embodiments, includes a pump assembly 40 for pumping production fluid, water, gas, contaminants, or other chemicals or fluids from the pump conduit 24. The illustrated pump assembly 40 includes an anchoring section 42 and a pump 44. The anchoring section 42 includes a number of components that secure the pump assembly 40 into a specific location within the pump conduit 24. For example, the anchoring section 42 may include packers or other compressible members that seal the space between the anchoring section 42 and the pump conduit 24. The anchoring section 42 may also include bolts, locks, clips, hooks, or other latching means to keep the pump assembly 40 in place so that the pump 44 can operate without moving, such as attaching to a wall.

Figures 3, 4:
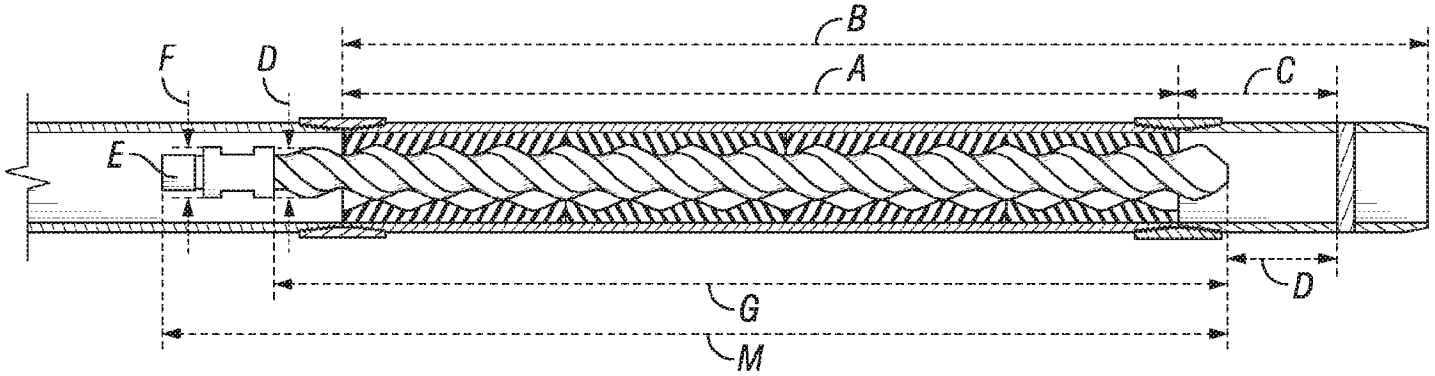
FIG. 3 illustrates an embodiment of a progressive cavity pump (PCP) usable in an embodiment of the pipeline booster pump system.
FIG. 4 provides dimensions associated with a particular type of PCP pump, a simplified PCP pump, usable in an embodiment of the pipeline booster pump system.

Although not necessarily limited to a particular means for producing fluid flow, a suitable pump 44 for use within the pump conduit 24 includes a corkscrew pump. In a particularly advantageous embodiment, the pump includes a progressive cavity pump or "PCP pump" as understood by persons of ordinary skill in the art. Although not necessarily limited to a particular type of PCP pump, a simplified PCP pump is depicted in FIG. 3 with corresponding dimensions listed in FIG. 4.

Suitably, the motor 46 and pump 44 can be coupled in a manner effective for the motor 46 to operationally power the pump 44 to recover fluids from subsea environments.

Figure 2:
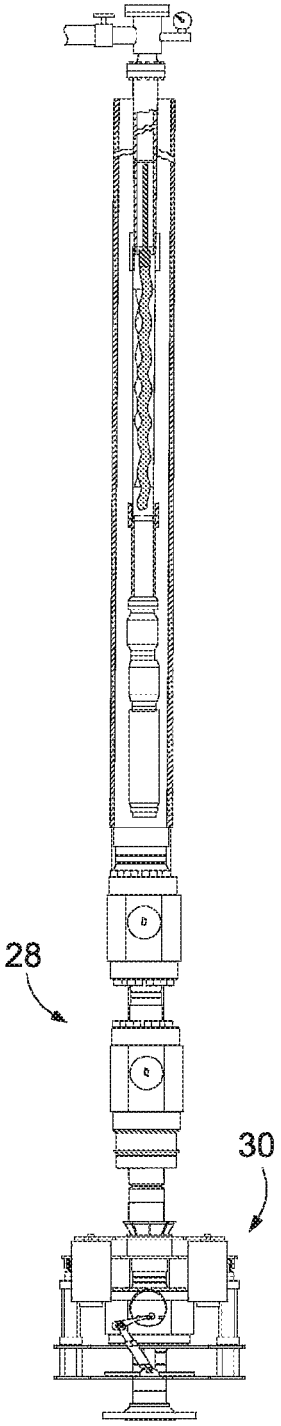
FIG. 2 illustrates an embodiment of a pipeline booster pump system that includes an emergency quick disconnect used in the production of fluid comprising hydrocarbons from a subsea production zone.

Although not necessarily limited to a particular type of connection, the motor 46 and pump 44 may connect to the valve assembly 28, as shown in FIGS. 1 and 2, that can connect to an emergency quick disconnect (EQD) 30, commonly referred to as "hot stabs" by persons of ordinary skill in the art of subsea pumping operations. In one aspect, a suitable emergency quick disconnect 30 is operationally configured to prevent any ambient water ingress into the motor, pump, and valve assembly during system operation. In another aspect, the emergency quick disconnects are operationally configured to allow the pumping system to release from the pipeline in an emergency situation. In operation, the emergency quick disconnects are operationally configured to release the attached pumping system, e.g., via an electric signal or an acoustic signal initiated from the surface. Although the system may be built to scale, including the emergency quick disconnects, suitable disconnects can range in size from about 5.08 cm to about 10.16 cm (about 2.0 inches to about 4.0 inches).

In operation, the motors(s) 46 can act as prime mover(s) for the corresponding pump 44, which in one aspect is effective for forming a vacuum on the pipeline resulting in the flow of pipeline fluids and hydrates into a conduit through the pipeline. The hydrate, or other plug or blockage, can be found in the pipeline, a pipeline end termination (PLET), a producing well or any combination thereof. As understood by persons of ordinary skill in the art, a typical subsea pipeline terminates at PLET—a structure that provides a connection of the pipeline to other system components. A suitable PLET includes a foundation that vertically supports the pipeline, the weight of one or more end connectors, and any valves employed. As shown, the PLET may also include a hub connector, a vertical connector or similar device operationally configured to act as a tie-in connection between the pipeline and the pumping system components.

As stated above, the present system 10 may be employed for boosting production in depleted production zones, dewatering pipelines, subsea hydrate recovery or remediation, plug remediation, dewatering purposes, flushing purposes, cleaning purposes, evacuation purposes, recovery purposes, testing pipeline integrity, and combinations thereof.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

The invention claimed is:

1. A subsea pipeline booster pump system, the system comprising:

a primary conduit forming a fluid connection between a valve assembly and a production zone;

a Y-block fluidly connected to the valve assembly, wherein the Y-block divides the primary conduit into an open secondary conduit and a pump secondary conduit; and a first hydraulic emergency quick disconnect positioned between the Y-block and the valve assembly, wherein the pump secondary conduit comprises a pump assembly internal to the pump secondary conduit, wherein the first hydraulic emergency quick disconnect selectively releases one of the open secondary conduit or the pump secondary conduit, and wherein the pump assembly comprises a progressive cavity pump.

2. The system of claim 1, further comprising at least one valve between the Y-block and the open secondary conduit, and at least another valve between the Y-block and the pump secondary conduit.

3. The system of claim 2, further comprising a second hydraulic emergency quick disconnect, wherein the second hydraulic emergency quick disconnect selectively releases the other of the open secondary conduit and the pump secondary conduit from the Y-block.

4. The system of claim 3, wherein the first and second hydraulic emergency quick disconnects are operationally configured to release upon receiving an electric signal or an acoustic signal initiated from the surface.

5. The system of claim 1, wherein the open secondary conduit comprises a clear fluid path leading to a production facility.

6. The system of claim 5, wherein the pump secondary conduit is in fluid communication with the production facility.

7. The system of claim 6, further comprising a switch valve allowing selective fluid communication between the production facility and the open secondary conduit, or between the production facility and the pump secondary conduit.

8. The system of claim 1, wherein the pump assembly further comprises an anchoring section securing the pump to a specific location within the pump secondary conduit.

9. The system of claim 8, wherein the anchoring section comprises compressible members, bolts, locks, clips, hooks, or combinations thereof.

10. The system of claim 9, wherein the specific location is an inner wall of the pump secondary conduit.

11. The system of claim 1, wherein the first hydraulic emergency quick disconnect is configured to prevent ambient water ingress into the valve assembly, the progressive cavity pump, a motor located within the pump secondary conduit, or combinations thereof, during operation of the subsea pipeline booster pump system.

12. A method of pumping fluid from a subsea environment to a surface production facility, the method comprising:

attaching a primary conduit to a pipeline or pipeline end termination;

splitting the primary conduit into an open secondary conduit and a pump secondary conduit by means of a Y-block;

attaching a first hydraulic emergency quick disconnect between the Y-block and one of the open secondary conduit or the pump secondary conduit;

connecting the open secondary conduit to the surface production facility;

powering a motor and a progressive cavity pump located within the pump secondary conduit; and disconnecting, with the first hydraulic emergency quick disconnect, the Y-block from one of the open secondary conduit or the pump secondary conduit.

13. The method of claim 12, wherein the step of attaching the first hydraulic emergency quick disconnect further comprises attaching a second emergency quick disconnect between the Y-block and the other of the open secondary conduit or pump secondary conduit.

14. The method of claim 13, further comprising the step of disconnecting the Y-block from the open secondary conduit and the pump secondary conduit upon receipt of a signal from the surface production facility.

15. The method of claim 12, wherein the step of powering the motor and the progressive cavity pump involves hydraulics, electric power, pneumatics, or combinations thereof.

16. The method of claim 12, wherein the step of attaching the primary conduit to the pipeline or pipeline end termination comprises attaching a valve assembly on a surface platform to a deep water or ultra deep water production zone.

* * * * *